US012168500B2

(12) United States Patent
Liao

(10) Patent No.: US 12,168,500 B2
(45) Date of Patent: Dec. 17, 2024

(54) DIVING MASK

(71) Applicant: Dong Guan City Blue Dolphin Sporting Goods Co., Ltd, Dongguan (CN)

(72) Inventor: Lixiang Liao, Guangdong (CN)

(73) Assignee: Dong Guan City Blue Dolphin Sporting Goods Co., Ltd, Dongguan (CN)

( * ) Notice: Subject to any disclaimer, the term of this patent is extended or adjusted under 35 U.S.C. 154(b) by 674 days.

(21) Appl. No.: 17/368,772

(22) Filed: Jul. 6, 2021

(65) Prior Publication Data

US 2022/0315180 A1 Oct. 6, 2022

(30) Foreign Application Priority Data

Apr. 2, 2021 (CN) ..... 202120685386.X

(51) Int. Cl.
*B63C 11/12* (2006.01)

(52) U.S. Cl.
CPC ..... *B63C 11/12* (2013.01); *B63C 2011/128* (2013.01)

(58) Field of Classification Search
CPC ..... B63C 11/12; B63C 2011/128; B63C 2011/123; B63C 2011/126; G03B 17/566
USPC ..... 351/43
See application file for complete search history.

(56) References Cited

U.S. PATENT DOCUMENTS

| | | | | |
|---|---|---|---|---|
| 6,009,561 | A * | 1/2000 | Bullock | A42B 3/227 24/297 |
| 9,033,596 | B2 * | 5/2015 | Samuels | G03B 17/561 396/421 |
| 2002/0124299 | A1 * | 9/2002 | Malcolm | A61F 9/025 2/439 |
| 2005/0072822 | A1 * | 4/2005 | Stotts | A45F 5/021 224/269 |
| 2017/0027591 | A1 * | 2/2017 | Schulz | A61L 24/0042 |
| 2017/0274969 | A1 * | 9/2017 | Lin | B63C 11/12 |
| 2018/0208281 | A1 * | 7/2018 | Wung | G03B 17/566 |
| 2018/0267335 | A1 * | 9/2018 | Knibbe | G02C 11/10 |
| 2019/0359302 | A1 * | 11/2019 | Shiue | F16M 11/2021 |

* cited by examiner

*Primary Examiner* — Travis S Fissel
(74) *Attorney, Agent, or Firm* — Andrew C. Cheng

(57) ABSTRACT

A diving mask includes a mask module including a mask frame, a fixing base fixed to the mask frame and a camera support base. The camera support base is detachably mounted to the fixing base, which facilitates installation and removal of the camera. The fixing base includes a receiving space with an insertion opening, a first locking opening located at a side of the receiving space and a second locking opening located at an opposite side of the receiving space. The camera support base includes an insertion portion and an elastic portion extending from the insertion portion obliquely such that when the elastic portion passes over the insertion opening to be received in the receiving space, the elastic portion is capable of restoring to its original state to selectively engage in the first locking opening or the second locking opening, which allows the shooting direction of the camera to be adjustable.

17 Claims, 7 Drawing Sheets

DIVING MASK

FIELD

The present application relates to the field of diving equipment, in particular to a diving mask.

BACKGROUND

Diving goggles are protective goggles configured to protect divers from choking water, protect the eyes of the divers from stimulation of water and allow the divers to see objects underwater. At present, some underwater works or sports usually need diving glasses. in many cases, due to needs of work or entertainment, shooting underwater scene is needed. The traditional approach is the divers wear diving goggles and hold a camera by hands. However, it is inconvenient for a diver to shoot underwater scene using a camera hold by his or her hands. Furthermore, in the process of shooting, the camera is easy to shake due to the effect of water flow, which reduces the shooting effect.

SUMMARY

It is desirable to provide an improved diving mask which solves at least one of the above-mentioned problems.

In one aspect, the present disclosure provides a diving mask which comprises a mask module comprising a mask frame and a lens fixed to the mask frame; and a camera fixing module comprising a fixing base configured to be fixed to the mask frame and a camera support base configured to mount a camera thereon. The camera support base is detachably mounted to the fixing base.

In some embodiments, the fixing base comprises a receiving space with an insertion opening and a first locking opening located at a side of the receiving space, and the camera support base comprises an insertion portion and an elastic portion extending from the insertion portion obliquely such that when the elastic portion passes over the insertion opening to be received in the receiving space, the elastic portion is capable of restoring to its original state to engage in the first locking opening.

In some embodiments, the fixing base further comprises a second locking opening located at an opposite side of the receiving space such that when the elastic portion passes over the insertion opening to be received in the receiving space, the elastic portion is capable of restoring to its original state to selectively engage in the first locking opening or the second locking opening.

In some embodiments, the insertion opening is defined at a top end of the fixing base.

In some embodiments, the top end of the fixing base has an arch shape.

In some embodiments, the fixing base comprises a first connecting portion and a second connecting portion, the receiving space is formed between the first connecting portion and the second connecting portion, the first locking opening is formed at the first connecting portion, the second locking opening is formed at the second connecting portion, and the receiving space communicates with the first locking opening and the second locking opening.

In some embodiments, the insertion portion defines a U-shaped slot surrounding the elastic portion such that the elastic portion has a cantilever structure.

In some embodiments, the elastic portion comprises a fixed end connected with the insertion portion and a free end extending from the fixed end in a direction toward the camera.

In some embodiments, the diving mask further comprises a wearing device which comprises a contacting part and strap parts extending from opposite sides of the contacting part.

In some embodiments, the diving mask further comprises an adjustment module which comprises a pair of mounting seats provided at opposite sides of the mask frame respectively, a pair of adjustment devices pivotably mounted to the mounting seats respectively, wherein the adjustment device is connected to the wearing device.

In some embodiments, the fixing base defines positioning holes and mask frame comprises posts fixedly received in the positioning holes.

In some embodiments, the mask frame is integrally formed with the fixing base via insert-moulding.

In some embodiments, the fixing base provides two mounting positions and the camera support base can be engaged with the fixing base selectively at any one of the two mounting positions, which allows the diving mask to easily change the shooting direction of the camera.

In some embodiments, the fixing base defines a first locking opening, a second locking opening and a receiving space located between the first locking opening and the second locking opening, the receiving space having an insertion opening; and the camera support base comprises an insertion portion configured to be inserted into the receiving space via the insertion opening and an elastic portion extending from the insertion portion obliquely such that when the elastic portion passes over the insertion opening, the elastic portion is capable of restoring to its original state to be selectively engaged in the first locking opening or the second locking opening.

The present disclosure has the following advantages:

The diving mask has an optimized structural design and a high degree of automation. The mask frame and the camera fixing module cooperate with each other to facilitate shooting underwater scene with a good shooting effect. The camera support base and the fixing base are detachably connected together, which facilitates installation and removal of the camera. The fixing base provides two mounting positions and the camera support base can be engaged with the fixing base selectively at any one of the two mounting positions, which allows the diving mask to easily change the shooting direction of the camera and makes the use of the camera more flexible.

BRIEF DESCRIPTION OF THE DRAWINGS

To more clearly explain the technical solutions of the embodiments of the application or related art, drawings used for describing the embodiments of the application or the related art will be briefly introduced below. Obviously, the drawings in the following description only illustrate some embodiments of the application, and those ordinarily skilled in the art can obtain other drawings according to the following ones without creative labor.

Figure 1:
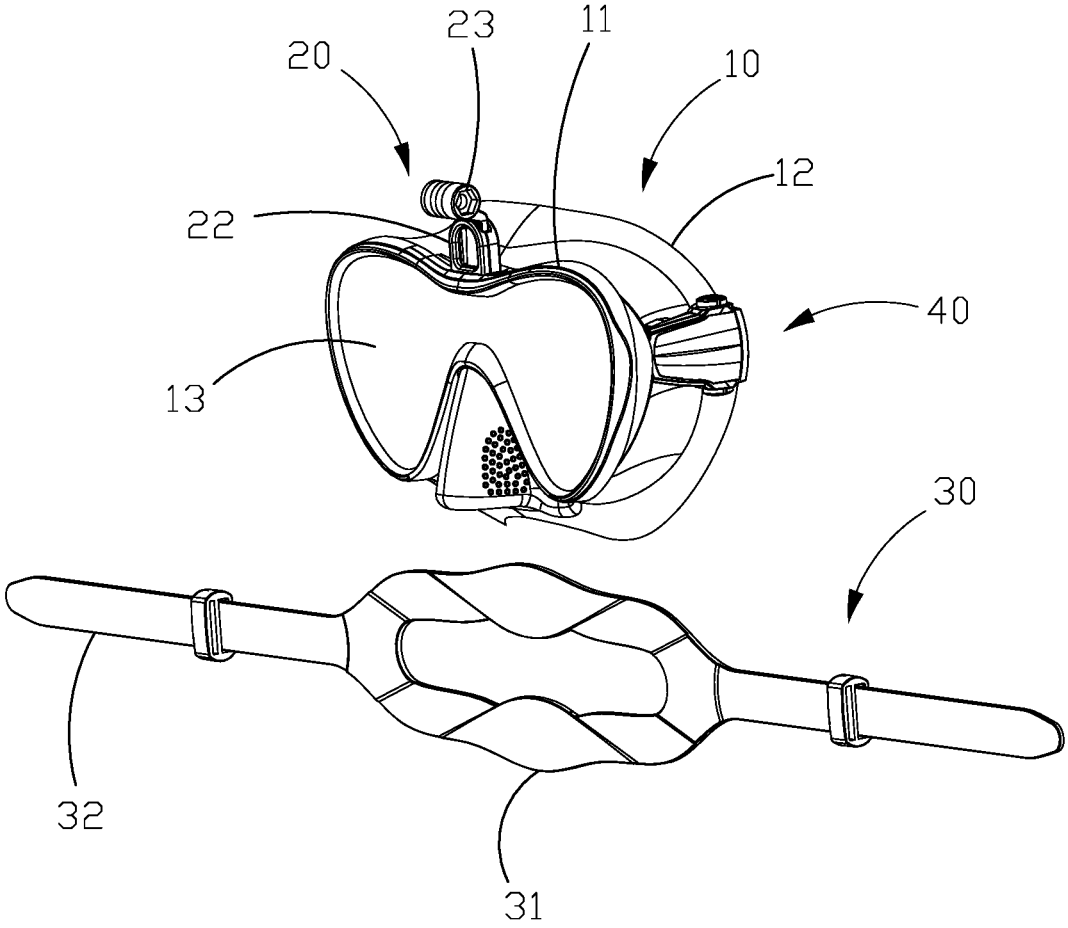
FIG. 1 illustrates a diving mask in accordance with an embodiment of the present disclosure.

REFERENCE NUMERALS mask module 10, mask frame 11, mounting groove 11*a*, mask liner 12, lens 13, camera fixing module 20, post 21, fixing base 22, the first connecting portion 221, the second connecting portion 222, the limiting portion 223, insertion opening 224, the first locking opening 225, the second locking opening 226, positioning hole 227, camera support base 23, insertion portion 231, elastic portion 232, slot 233, wearing module 30, contacting part 31, strap part 32, adjusting module 40, mounting seat 41, adjustment device 42, connecting part 42*a*, adjusting part 42*b*.

DESCRIPTION OF THE EMBODIMENTS

To gain a better understanding of the present application, the application will be more comprehensively described below with reference to relevant drawings. While the drawings illustrate some preferred embodiments of the application, the application can be implemented in different forms, and shall not be limited to the embodiments described in the specification. In fact, these embodiments are provided for the purpose of a more thorough and comprehensive understanding of the contents disclosed in the application.

Unless otherwise defined, all technical and scientific terms used herein have the same meaning as commonly understood by those skilled in the technical field of the present application. The terminology used in the description of the present application herein is only for the purpose of describing specific embodiments, and is not intended to limit the scope of the present application.

FIGS. 1 to 7 illustrate a diving mask according to an embodiment of the present invention.

In some embodiments, the diving mask includes a mask module 10 and a camera fixing module 20 installed on the mask module 10. The mask module 10 is configured for connection and installation of the overall structure. The camera fixing module 20 installed on the top of the mask module 10 is configured for fixing a camera, which has a good fixing effect and is convenient for underwater shooting.

Figure 2:
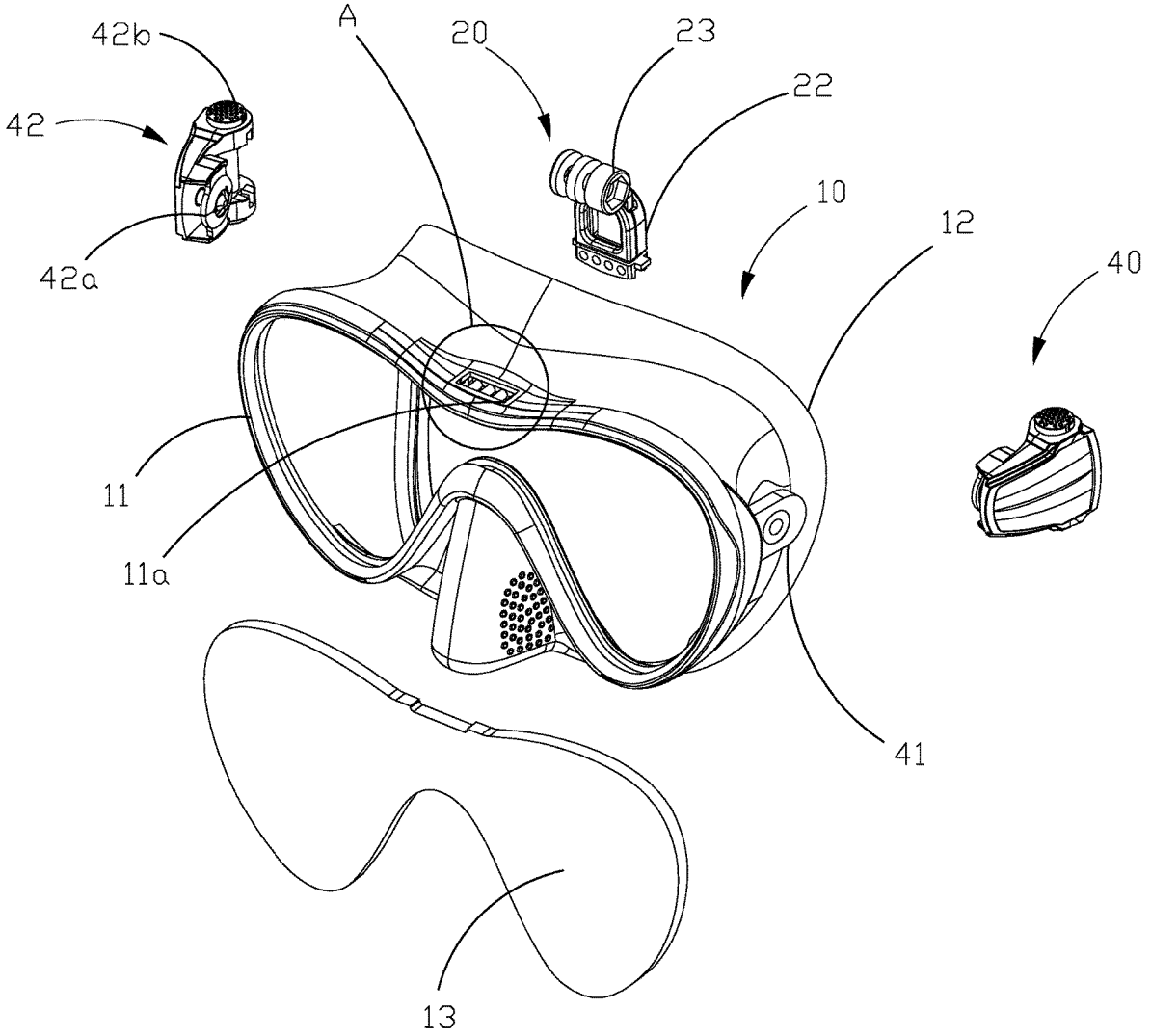
FIG. 2 is an exploded view of the diving mask of FIG. 1, with the wearing module removed.
Figure 3:
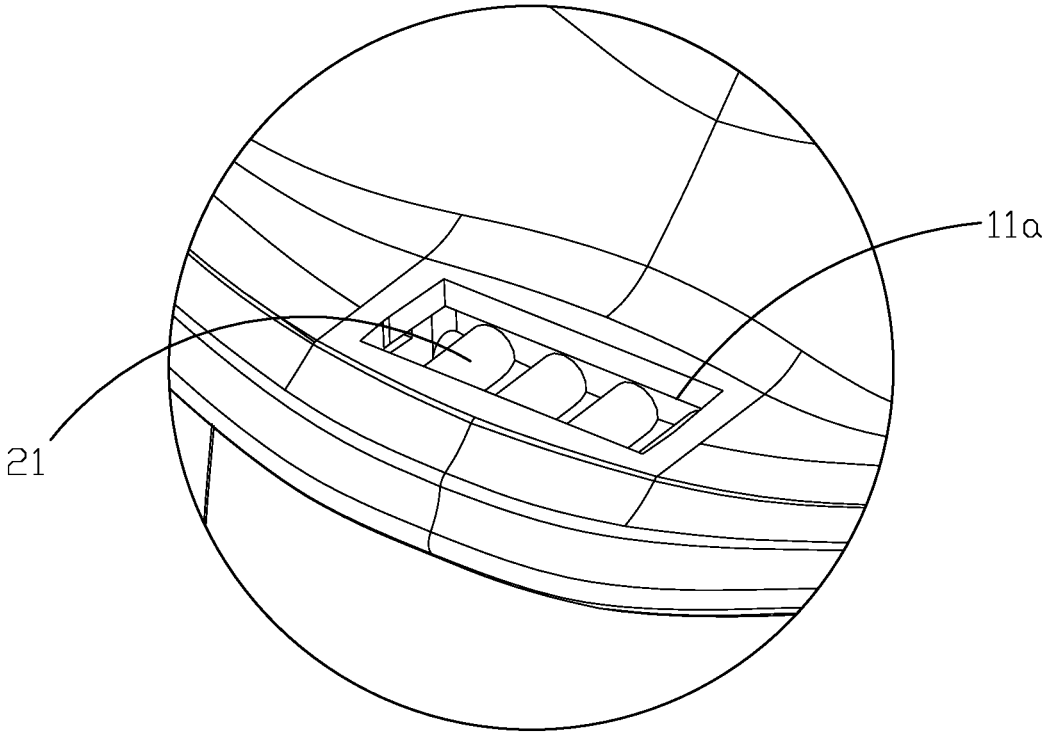
FIG. 3 is an enlarged view of the circled portion A of FIG. 2.
Figure 4:
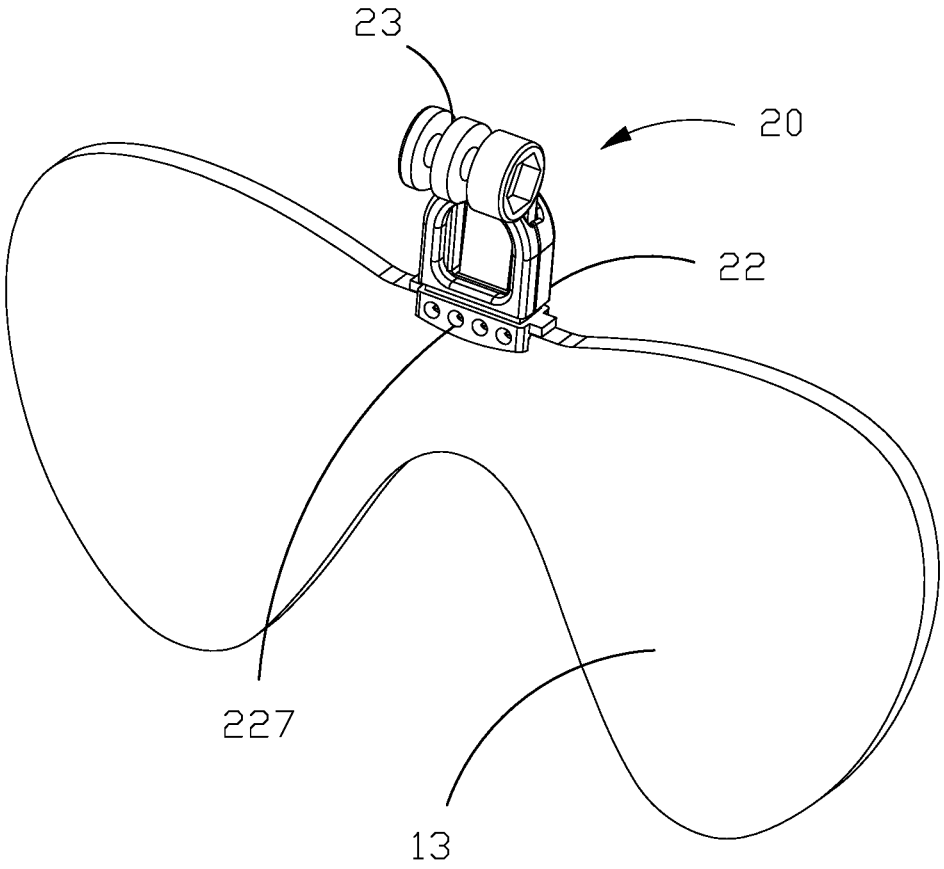
FIG. 4 is a schematic diagram of the combination of the camera fixing module and the lens of the diving mask of FIG. 1.
Figure 5:
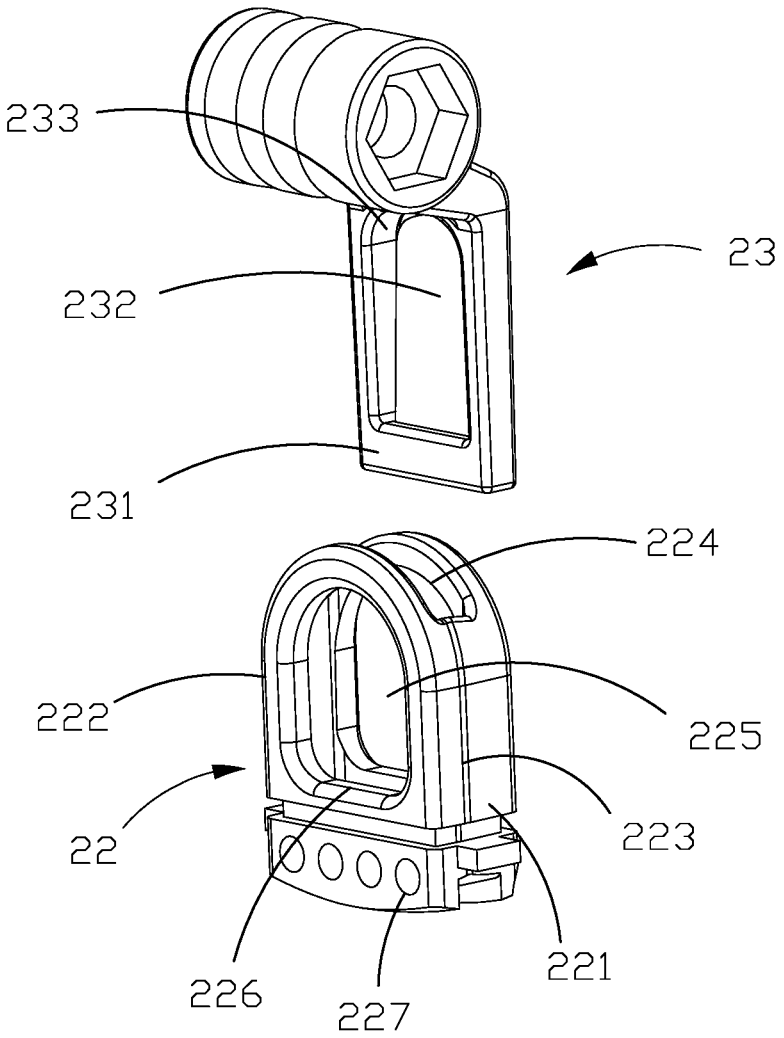
FIG. 5 is an exploded view of the camera fixing module of the diving mask of FIG. 1.
Figure 6:
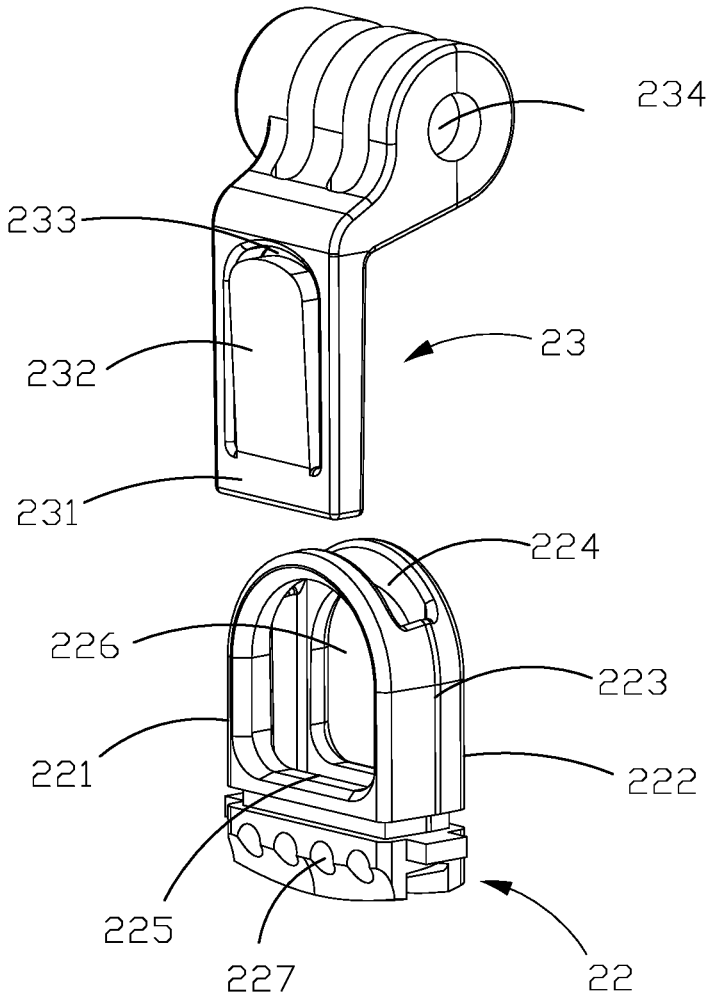
FIG. 6 is similar to FIG. 5, but viewed from another aspect.
Figure 7:
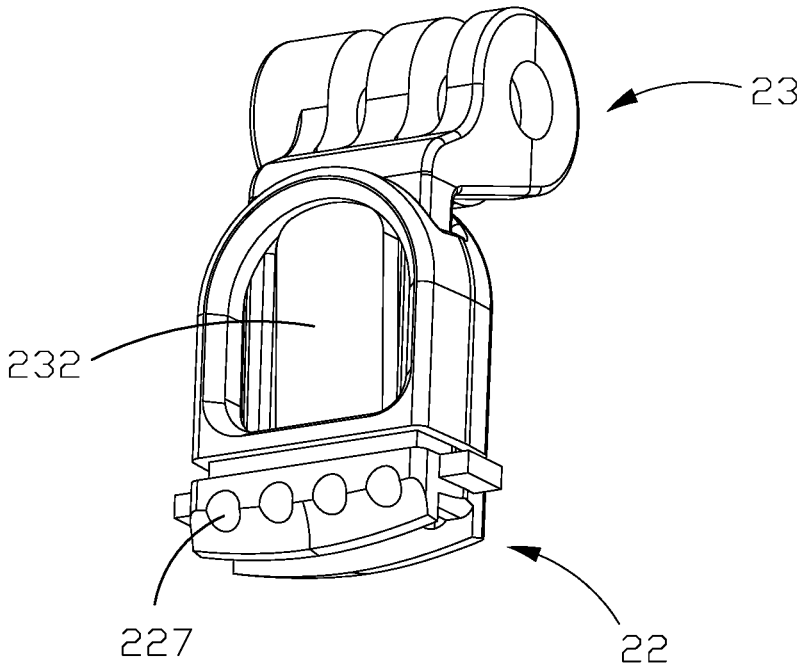
FIG. 7 is an assembled view of FIG. 6.

As shown in FIGS. 1 to 3, the mask module 10 includes a mask frame 11, and a mask liner 12 and a lens 13 mounted on the mask frame 11. The mask frame 11 and the mask liner 12 are made of silicone. In this embodiment, the mask frame 11 and the mask liner 12 are integrally formed with the lens 13 via injection-molded. Thus, the mask frame 11, the mask liner 12 and the lens 13 form an integral structure with simple appearance and light weight and without gap formed therebetween.

As shown in FIGS. 4 to 7, the camera fixing module 20 includes a fixing base 22 connected to the mask frame 11 and a camera support base 23 for mounting one or more cameras 234 (shown in FIG. 6) therein. The camera support base 23 is detachably connected to the fixing base 22 by snap-fitting. In this embodiment, the camera supporting base 23 and the fixing base 22 are detachably connected, which facilitates installation and removal of the camera 234.

The mask frame 11 includes a plurality of posts 21 (shown in FIG. 3). The mask frame 11 defines a mounting groove 11*a* and the fixing base 22 defines a plurality of positioning holes 227. The posts 21 are located in the mounting groove 11*a* and are arranged corresponding to the positioning holes 227 respectively so that the fixing base 22 can be fixed on the mask frame 11 by the posts 21 extending through the positioning holes 227. In some embodiments, the fixing base 22 can be fixed to the mask frame 11 via insert-molding. That is, after the fixing base 22 is formed, the mask frame 11 is integrally formed with the fixing base 22 via insert-molding and material of the mask frame 11 flow into the positioning holes 227 to form the posts 21. Alternatively, the fixing base 22 can be fixed to the mask frame 11 by other fixing means.

The fixing base 22 comprises a receiving space with an insertion opening 224 and a first locking opening 225 communicating with the receiving space. The camera support base 23 includes an insertion portion 231 and an elastic portion 232 connected to the insertion portion 231. After the insertion portion 231 of the camera support base 23 is inserted into the receiving space of the fixing base 22, the elastic portion 232 of the camera support base 23 can be engaged in the first locking opening 225.

The fixing base 22 includes a first connecting portion 221, a second connecting portion 222, and a limiting portion 223 connecting the first connecting portion 221 with the second connecting portion 222. The receiving space is located between the first connecting portion 221 and the second connecting portion 222. The first locking opening 225 travels through the first connecting portion 221 horizontally. The fixing base 22 has an arch-shaped top end such that the first locking opening 225 has an arc top surface.

The insertion opening 224 of the receiving space is arranged at the top end of the fixing base 22 such that the camera support base 23 can be inserted into the fixing base 22 in an upper-to-down direction with a good locking effect.

The second connecting portion 222 is provided with a second locking opening 226. The second locking opening 226 travels through the second connecting portion 221 horizontally and communicates with the receiving space. The first locking opening 225 and the second locking openings 226 are respectively located at opposite sides of the receiving space and the receiving space is located between the first locking opening 225 and the second locking openings 226. The receiving space extends downwardly beyond the first and second locking openings 225, 226 such that when the insertion portion is received in the receiving space, the bottom end of the insertion portion is sandwiched between the first and second connecting portion 221, 222.

In some other embodiments, the camera support base 23 can be rotated 180 degree and then be inserted into the receiving space via the insertion opening 224 such that the elastic portion 232 is engaged in the second locking opening 226. When the elastic portion 232 is engaged in the first locking opening 225, the shooting direction of the camera is along a first direction. When the elastic portion 232 is engaged in the second locking opening 226, the shooting direction of the camera is along a second direction which is reversed to the first direction. Thus, it is convenient to change the shooting direction of the camera of the diving mask, which makes the use of the camera more flexible.

The insertion portion 231 defines a U-shaped slot 233 surrounding the elastic portion 232 such that the elastic portion 232 forms a cantilever structure. The bottom end of the elastic portion 232 away from the camera is connected to the bottom end of the insertion portion 231. The elastic portion 232 extends obliquely from the bottom end of the insertion portion 231 toward the first connecting portion 221 or the second connecting portion 222. When the insertion portion 231 is inserted into the receiving space of the fixing base 22 via the insertion opening 224, the elastic portion 232 is continuously squeezed by the boundary of the insertion opening 224 until the elastic portion 232 passes over the boundary of the insertion opening 224. After the elastic portion 232 passes over the boundary of the insertion opening 224, the insertion portion 231 is completely received in the receiving space of the fixing base 22, and the elastic portion 232 restores to its original state and the top free end the elastic portion 232 extends into the first locking opening 225 or the second locking opening 226 to engage with the top surface of the first locking opening 225 or the second locking opening 226 to thereby prevent the camera support base 23 from escaping from the fixing base 22. The insertion portion 231 is received in the receiving space of the fixing base 22, which can locate the insertion portion 231 in left-and-right directions and front-and-rear directions.

As shown in FIGS. 1 to 3, the diving mask of the present disclosure further includes a wearing module 30. The wearing module 30 includes a contacting part 31 configured to contacting faces of users and strap parts 32 extending from opposite sides of the contacting part 31.

The diving mask of the present invention further includes an adjustment module 40 which includes a mounting seat 41 provided at opposite sides of the mask module 10 and an adjustment device 42 installed on the mounting seat 41. The adjustment device 42 is connected to the wearing module 30. The adjustment device 42 includes a connecting part 42*a* and an adjusting part 42*b*. The connecting part 42*a* is pivotably connected to the mounting seat 41 so that the adjustment device 42 is pivotable relative to the mask module 10. The adjusting part 42*b* is connected to the strap part 32. In this embodiment, the wearing module 30 and the adjustment module 40 cooperate with each other to facilitate adjusting wearing of the diving mask according to the size of the user's head.

In some embodiments, the elastic portion 232 has an arc top end. During the process of the insertion portion 231 being inserted into the receiving space of the fixing base 22 via the insertion opening 224, the elastic portion 232 is continuously squeezed inwardly by the boundary of the insertion opening 224 until the elastic portion 232 passes over the boundary of the insertion opening 224. After the elastic portion 232 passes over the boundary of the insertion opening 224, the insertion portion 231 is completely received in the receiving space of the fixing base 22, and the elastic portion 232 restores to its original state and the top free end the elastic portion 232 extends into the first locking opening 225 to engage with the top surface of the first locking opening 225 to thereby prevent the camera support base 23 from escaping from the fixing base 22. In some other embodiments, the camera support base 23 can be rotated 180 degree and the insertion portion 231 is then inserted into the receiving space of the fixing base 22 via the insertion opening 224 such that the top free end of the elastic portion 232 engages with the top surface of the second locking opening 226. Thus, the diving mask of the present disclosure can easily change the shooting direction of the camera, which makes the use of the camera more flexible.

The diving mask of the present disclosure has an optimized structure design and a high degree of automation. The mask frame 11 and the camera fixing module 20 cooperate with each other, which is convenient for shooting underwater and has a good shooting effect. Specifically, the diving mask includes the mask module 10 for connection and installation of the overall structure and the camera fixing module 20 which is installed on the top of the mask module 10 for fixing the camera therein. The camera support base 23 and the fixing base 22 are detachably connected together, which facilitates installation and removal of the camera.

It will be apparent to those skilled in the art that various modifications and variations can be made to the disclosed structure without departing from the scope or spirit of the application. In view of the foregoing, it is intended that the present application cover modifications and variations of this disclosure provided they fall within the scope of the following claims and their equivalents.

What is claimed is:

1. A diving mask, comprising:

a mask module comprising a mask frame and a lens fixed to the mask frame; and a camera fixing module comprising a fixing base configured to be fixed to the mask frame and a camera support base configured to mount a camera thereat;

wherein the camera support base is detachably mounted to the fixing base;

the fixing base comprises a receiving space with an insertion opening formed at a top end thereof and a first locking opening located at a side of the receiving space in a front-back direction, the locking opening being in communication with the receiving space;

the camera support base comprises an insertion portion configured to be inserted into the receiving space via the insertion opening in an upper-to-down direction and an elastic portion extending from the insertion portion obliquely such that the elastic portion is deformed in the front-back direction when passing through the insertion opening and is capable of restoring to its original state to be engaged in the first locking opening after passing over the insertion opening;

wherein the fixing base further comprises a second locking opening located at an opposite side of the receiving space in the front-back direction such that when the elastic portion passes over the insertion opening, the elastic portion is capable of restoring to its original state to selectively engage in the first locking opening or the second locking opening:

when the elastic portion is engaged in the first locking opening, the shooting direction of the camera is along a first direction; and when the elastic portion is engaged in the second locking opening, the shooting direction of the camera is along a second direction which is reversed to the first direction.

2. The diving mask according to claim 1, wherein the insertion opening is defined at a top end of the fixing base.

3. The diving mask according to claim 2, wherein the top end of the fixing base has an arch shape.

4. The diving mask according to claim 1, wherein the fixing base comprises a first connecting portion and a second connecting portion, the receiving space is formed between the first connecting portion and the second connecting portion in the front-back direction, the first locking opening is formed at the first connecting portion, the second locking opening is formed at the second connecting portion, and the receiving space communicates with the first locking opening and the second locking opening.

5. The diving mask according to claim 2, wherein the insertion portion defines an inverted U-shaped slot surrounding the elastic portion to cause the elastic portion to form a cantilever structure which extends upwardly and obliquely from the insertion portion.

6. The diving mask according to claim 5, wherein the elastic portion comprises a fixed end connected with the insertion portion and a free end extending from the fixed end in a direction toward the camera; and when the insertion portion is received in the receiving space, the free end of the elastic portion is engaged with a top surface of the first locking opening.

7. The diving mask according to claim 1, further comprising a wearing device which comprises a contacting part and strap parts extending from opposite sides of the contacting part.

8. The diving mask according to claim 7, further comprising an adjustment module which comprises a pair of mounting seats provided at opposite sides of the mask frame respectively, and a pair of adjustment devices pivotably mounted to the mounting seats respectively, wherein the adjustment device is connected to the wearing device.

9. The diving mask according to claim 1, wherein the fixing base defines positioning holes and the mask frame comprises posts fixedly received in the positioning holes.

10. The diving mask according to claim 1, wherein the mask frame is integrally formed with the fixing base via insert-moulding.

11. The diving mask according to claim 1, wherein the fixing base provides two mounting positions and the camera support base can be engaged with the fixing base selectively at any one of the two mounting positions, which allows the diving mask to easily change the shooting direction of the camera.

12. The diving mask according to claim 11, wherein the fixing base defines a first locking opening, a second locking opening and a receiving space located between the first locking opening and the second locking opening, the receiving space having an insertion opening; and the camera support base comprises an insertion portion configured to be inserted into the receiving space via the insertion opening and an elastic portion extending from the insertion portion obliquely such that when the elastic portion passes over the insertion opening, the elastic portion is capable of restoring to its original state to be selectively engaged in the first locking opening or the second locking opening.

13. The diving mask according to claim 12, wherein the receiving space extends downwardly beyond the first and second locking openings such that when the insertion portion is received in the receiving space, a bottom end of the insertion portion is sandwiched between the first and second connecting portion.

14. The diving mask according to claim 1, wherein the mask frame includes a plurality of posts and a mounting groove, and the fixing base defines a plurality of positioning holes, the posts are located in the mounting groove and extend through the positioning holes in the front-back direction respectively.

15. The diving mask according to claim 14, wherein the mask frame is integrally formed with the fixing base via insert-molding and material of the mask frame flows into the positioning holes to form the posts.

16. A diving mask, comprising:

a mask module comprising a mask frame and a lens fixed to the mask frame; and a camera fixing module comprising a fixing base configured to be fixed to the mask frame and a camera support base configured to mount a camera thereat;

wherein the camera support base is detachably mounted to the fixing base;

the fixing base comprises a receiving space with an insertion opening formed at a top end thereof and a first locking opening located at a side of the receiving space in a front-back direction, the locking opening being in communication with the receiving space;

the camera support base comprises an insertion portion configured to be inserted into the receiving space via the insertion opening in an upper-to-down direction and an elastic portion extending from the insertion portion obliquely such that the elastic portion is deformed in the front-back direction when passing through the insertion opening and is capable of restoring to its original state to be engaged in the first locking opening after passing over the insertion opening; and the mask frame includes a plurality of posts and a mounting groove, and the fixing base defines a plurality of positioning holes, the posts are located in the mounting groove and extend through the positioning holes in the front-back direction respectively.

17. The diving mask according to claim 16, wherein the mask frame is integrally formed with the fixing base via insert-molding and material of the mask frame flows into the positioning holes to form the posts.

* * * * *